US011717026B1

(12) United States Patent
Parker

(10) Patent No.: US 11,717,026 B1
(45) Date of Patent: Aug. 8, 2023

(54) BOWL WITH DETACHABLE GRINDER FOR USE WITH A PIPE

(71) Applicant: William Parker, Durham, NC (US)

(72) Inventor: William Parker, Durham, NC (US)

( * ) Notice: Subject to any disclaimer, the term of this patent is extended or adjusted under 35 U.S.C. 154(b) by 588 days.

(21) Appl. No.: 16/902,417

(22) Filed: Jun. 16, 2020

Related U.S. Application Data

(63) Continuation-in-part of application No. 16/253,282, filed on Jan. 22, 2019, now Pat. No. 11,510,435.

(51) Int. Cl.

| | |
|---|---|
| ***A24F 9/00*** | (2006.01) |
| ***A24F 1/30*** | (2006.01) |
| ***A24F 5/00*** | (2006.01) |
| ***A24F 3/00*** | (2006.01) |
| ***B02C 18/22*** | (2006.01) |
| ***A24B 7/06*** | (2006.01) |
| ***B02C 18/06*** | (2006.01) |

(52) U.S. Cl.
CPC ..... *A24F 9/00* (2013.01); *A24B 7/06* (2013.01); *A24F 1/30* (2013.01); *A24F 3/00* (2013.01); *A24F 5/00* (2013.01); *B02C 18/067* (2013.01); *B02C 18/2216* (2013.01)

(58) Field of Classification Search
None
See application file for complete search history.

(56) References Cited

U.S. PATENT DOCUMENTS

| | | | |
|---|---|---|---|
| 682,278 | A | 9/1901 | Roller |
| 4,171,703 | A | 10/1979 | Locke |
| 6,418,936 | B1 | 7/2002 | Lee |
| D760,430 | S | 6/2016 | Hanna |
| 9,974,331 | B2 | 5/2018 | Portz |
| 10,015,985 | B1 | 7/2018 | Blakely, III |
| 2010/0101590 | A1 | 4/2010 | Pflaum |
| 2016/0143352 | A1 | 5/2016 | Bavar |

FOREIGN PATENT DOCUMENTS

| | | |
|---|---|---|
| WO | 2011002728 | 1/2011 |

*Primary Examiner* — Kelly M Gambetta
*Assistant Examiner* — Katherine A Will
(74) *Attorney, Agent, or Firm* — Kyle A. Fletcher, Esq.

(57) ABSTRACT

The bowl with attachable grinder for use with a pipe is a mechanical structure. The bowl with attachable grinder for use with a pipe claims the benefit of United States 35 USC 120 from non-provisional application U.S. Ser. No. 16/253,282 filed on Jan. 22, 2019. The prior disclosure comprises a partitioned bowl. A gas phase of a pharmacologically active media generated by the combustion of a smoking material passes through the partitioned bowl. The bowl with attachable grinder for use with a pipe comprises an exterior screw thread and a burr grinder. The exterior screw thread removably attaches the burr grinder to the prism structure of the partitioned bowl. The burr grinder grinds the smoking material in preparation for the combustion of the smoking material within the partitioned bowl. The burr grinder deposits the ground smoking material directly into the prism structure of the partitioned bowl.

20 Claims, 5 Drawing Sheets

BOWL WITH DETACHABLE GRINDER FOR USE WITH A PIPE

CROSS REFERENCES TO RELATED APPLICATIONS

This non-provisional application is a continuation-in-part application filed under 37 CFR 1.53(b) that claims the benefit of United States 35 USC 120 from non-provisional application U.S. Ser. No. 16/253,282 filed on Jan. 22, 2019 by the inventor: William Parker of Raleigh, N.C. This non-provisional application incorporates non-provisional application U.S. Ser. No. 16/253,282 in its entirety.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of tobacco including smoker's requisites, more specifically, a hookah. (A24F1/30)

This non-provisional application is a continuation-in-part application filed under 37 CFR 1.53(b) that claims the benefit of United States 35 USC 120 from non-provisional application U.S. Ser. No. 16/253,282 filed on Jan. 22, 2019 by the inventor: William Parker of Raleigh, N.C. This non-provisional application incorporates non-provisional application U.S. Ser. No. 16/253,282 in its entirety.

The present disclosure will only reference the elements of the non-provisional application U.S. Ser. No. 16/253,282 that are relevant to the innovations disclosed within this application. This is done for purposes of simplicity and clarity of exposition. The applicant notes that this disclosure incorporates non-provisional application U.S. Ser. No. 16/253,282 in its entirety into this application. The fact that any specific innovation selected from the one or more innovations disclosed within U.S. Ser. No. 16/253,282 is not addressed in this application should not be interpreted as an indication of defect in the above referenced patent.

Within this disclosure, the non-provisional application U.S. Ser. No. 16/253,282 will also be referred to as the prior disclosure.

A summary of the disclosures contained within the prior disclosure that are relevant to the present disclosure is provided below. This summary is provided for clarity and convenience and is not intended to fully represent or reflect the disclosures contained within the prior disclosure. If a discrepancy occurs between this summary and the prior disclosure, the prior disclosure should be considered correct and this summary should be considered in error.

The prior disclosure discloses is a bowl configured for use with a hookah 182. The prior disclosure is configured for use with a smoking material 181. The prior disclosure contains the smoking material 181 during a combustion process. The combustion of the smoking material 181 releases the pharmacologically active media 183 in a gas phase. The prior disclosure comprises a partitioned bowl 101 and a transport structure 102. The partitioned bowl 101 is the partitioned structure that contains one or more doses of the smoking material 181. The transport structure 102 forms a fluidic connection between the partitioned bowl 101 and the hookah 182 that transports the gas phase of the pharmacologically active media 183 from the partitioned bowl 101 to the hookah 182.

The smoking material 181 is defined elsewhere in this disclosure. The hookah 182 is defined elsewhere in this disclosure. The gas phase of the pharmacologically active media is defined elsewhere in this disclosure.

The partitioned bowl 101 is a hollow structure. The partitioned bowl 101 has the shape of a composite prism. The partitioned bowl 101 contains the smoking material 181 for storage. The partitioned bowl 101 contains the smoking material 181 during the combustion process that releases the gas phase of the pharmacologically active media 183. Each of the partitions formed within the partitioned bowl 101 forms a partitioned storage space such that the smoking material 181 can be segregated into a plurality of independently stored doses. Each separate dose contained in the partitioned bowl 101 can be consumed independently of other independent doses contained within the partitioned bowl 101.

The partitioned bowl 101 comprises a prism structure 111, a pyramid structure 112, and a plurality of bulkheads 114. The prism structure 111 is a hollow tubular structure that has a prism shape. The pyramid structure 112 is a hollow structure that has a truncated pyramid shape. The base and the truncated apex of the pyramid structure 112 are open such that atmospheric gas will flow through the pyramid structure 112. The plurality of bulkheads 114 form the barriers that partition the interior space of the partitioned bowl 101. The prism structure 111 is further defined with a prism intake port 123 and a prism exhaust port 124. The pyramid structure 112 is further defined with a pyramid intake port 124, and a pyramid exhaust port 134.

The prism intake port 123 refers to a first open end of the prism structure 111. The atmospheric gas drawn into the hookah 182 enters the invention through the prism intake port 123. The prism intake port 123 is the open congruent end of the prism structure 111 that is distal from the pyramid structure 112. The prism exhaust port 124 refers to a second open congruent end of the prism structure 111. The atmospheric gas drawn through the prism structure 111 is discharged into the pyramid structure 112 through the prism exhaust port 124. The prism exhaust port 124 is the end of the prism structure 111 that attaches to the pyramid structure 112.

The atmospheric gas drawn into the hookah 182 enters the pyramid structure 112 through the pyramid intake port 124. The pyramid intake port 124 is the open base of the pyramid shape of the pyramid structure 112. The pyramid intake port 124 is the end of the pyramid structure 112 that attaches to the prism exhaust port 124 of the prism structure 111. The pyramid exhaust port 134 is the open truncated apex of the truncated pyramid shape of the pyramid structure 112. The pyramid intake port 124 of the pyramid structure 112 is geometrically identical to the prism exhaust port 124 of the prism structure 111. The atmospheric gas drawn through the pyramid structure 112 is discharged into the transport structure 102 through the pyramid exhaust port 134. The pyramid exhaust port 134 is the end of the pyramid structure 112 that is distal from the prism structure 111.

SUMMARY OF INVENTION

This non-provisional application is a continuation-in-part application filed under 37 CFR 1.53(b) that claims the benefit of United States 35 USC 120 from non-provisional application U.S. Ser. No. 16/253,282 filed on Jan. 22, 2019 by the inventor: William Parker of Raleigh, N.C. This non-provisional application incorporates non-provisional application U.S. Ser. No. 16/253,282 in its entirety.

The present disclosure will only reference the elements of the non-provisional application U.S. Ser. No. 16/253,282 that are relevant to the innovations disclosed within this application. This is done for purposes of simplicity and clarity of exposition. The applicant notes that this disclosure incorporates non-provisional application U.S. Ser. No. 16/253,282 in its entirety into this application. The fact that any specific innovation selected from the one or more innovations disclosed within U.S. Ser. No. 16/253,282 is not addressed in this application should not be interpreted as an indication of defect in the above referenced patent.

Within this disclosure, the non-provisional application U.S. Ser. No. 16/253,282 will also be referred to as the prior disclosure.

The bowl with attachable grinder for use with a pipe is a mechanical structure. The bowl with attachable grinder for use with a pipe is configured for use with the prior disclosure. The prior disclosure comprises a partitioned bowl. The partitioned bowl comprises a prism structure and a pyramid structure. The prism structure is a hollow prism-shaped structure. The pyramid structure is a hollow pyramid shaped structure. The pyramid structure attaches to the prism structure to form a composite prism structure. A gas phase of a pharmacologically active media passes through the composite prism structure formed by the prism structure and the pyramid structure. The gas phase of a pharmacologically active media passes is generated by the combustion of a smoking material.

The bowl with attachable grinder for use with a pipe comprises an exterior screw thread and a burr grinder. The exterior screw thread removably attaches the burr grinder to the prism structure of the partitioned bowl. The burr grinder grinds the smoking material in preparation for the combustion of the smoking material within the partitioned bowl. The burr grinder deposits the ground smoking material directly into the prism structure of the partitioned bowl.

These together with additional objects, features and advantages of the bowl with attachable grinder for use with a pipe will be readily apparent to those of ordinary skill in the art upon reading the following detailed description of the presently preferred, but nonetheless illustrative, embodiments when taken in conjunction with the accompanying drawings.

In this respect, before explaining the current embodiments of the bowl with attachable grinder for use with a pipe in detail, it is to be understood that the bowl with attachable grinder for use with a pipe is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bowl with attachable grinder for use with a pipe.

It is therefore important that the claims be regarded as including such equivalent construction insofar as they do not depart from the spirit and scope of the bowl with attachable grinder for use with a pipe. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
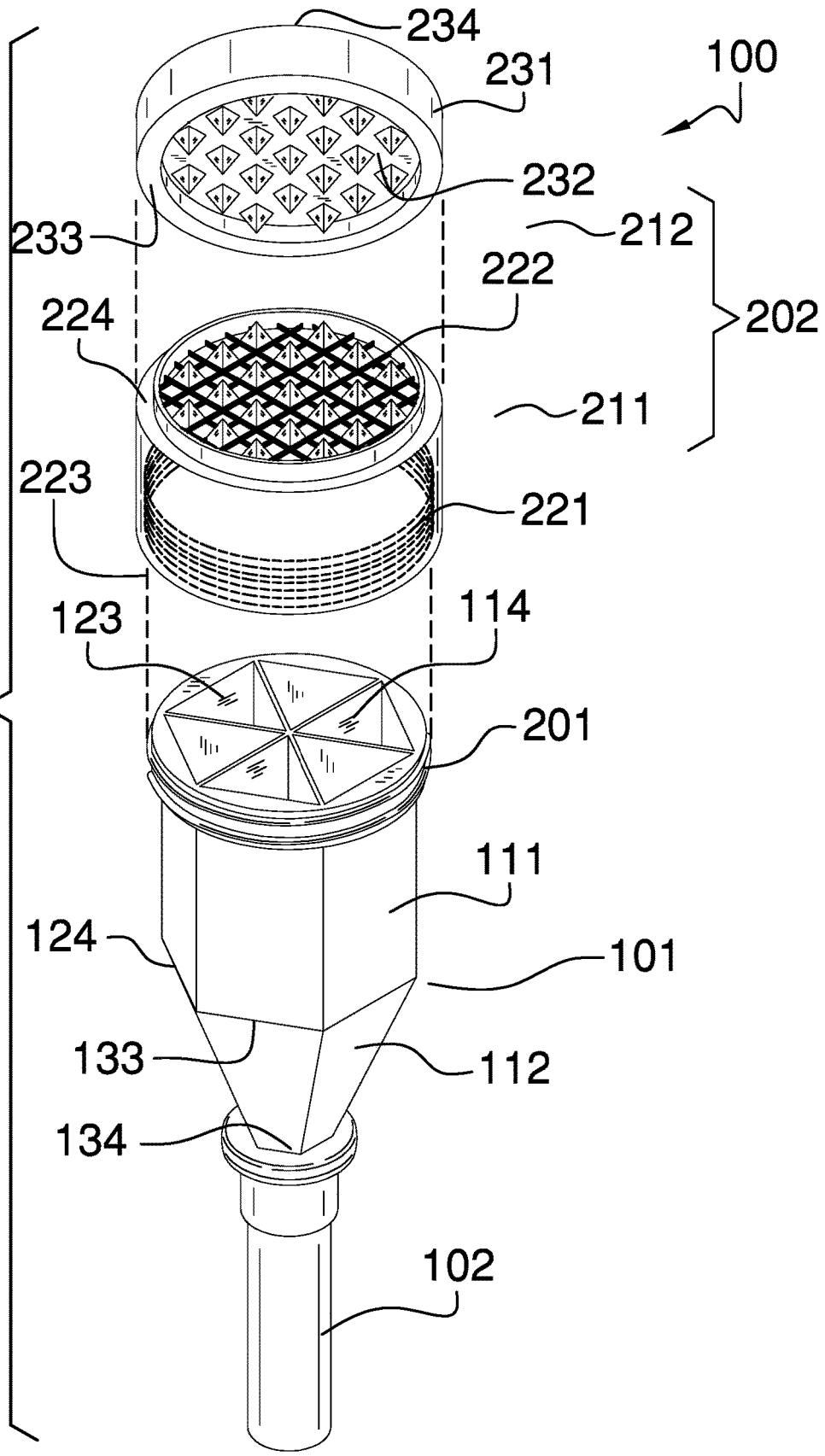
FIG. 1 is an exploded view of an embodiment of the disclosure.
Figure 2:
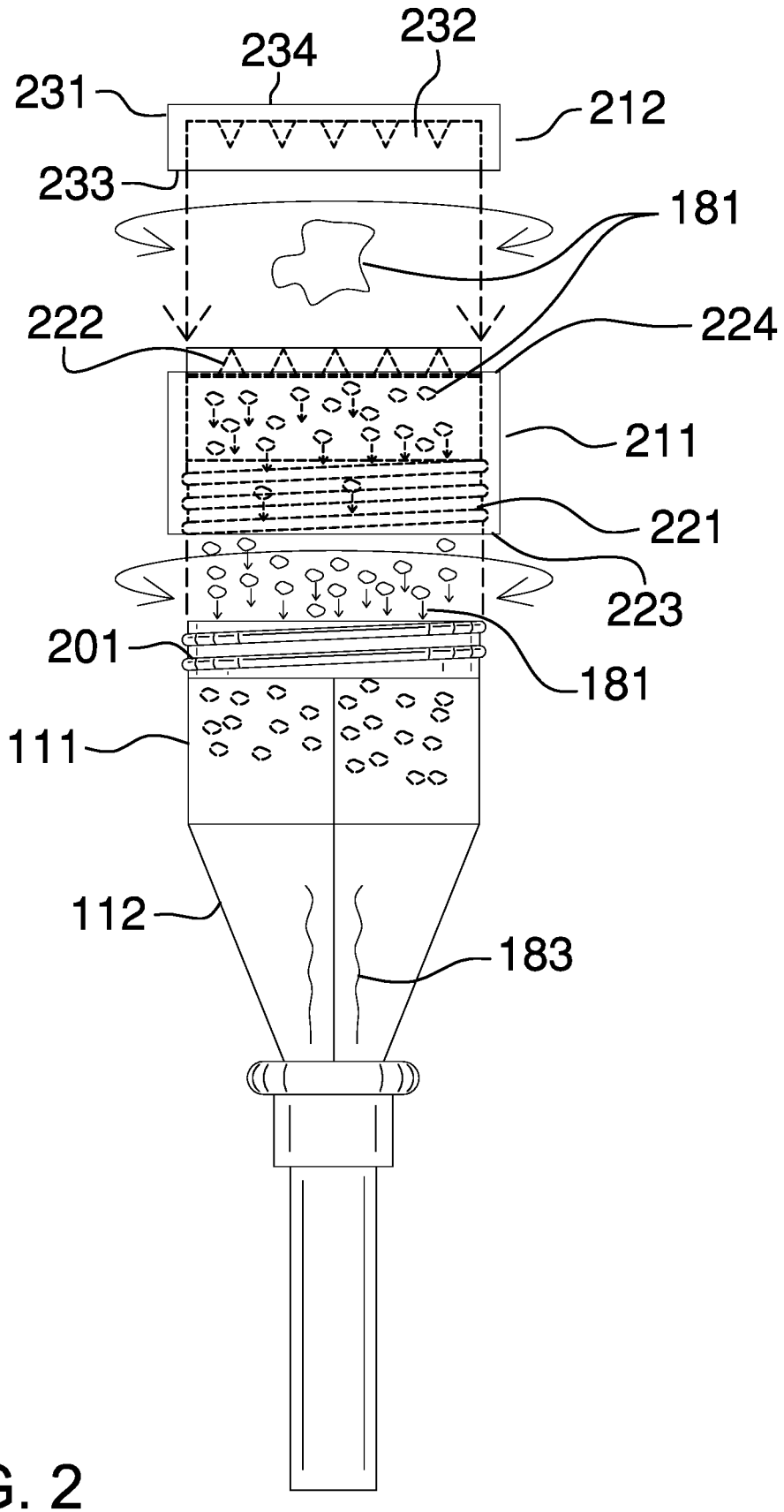
FIG. 2 is an in-use view of an embodiment of the disclosure.
Figure 3:
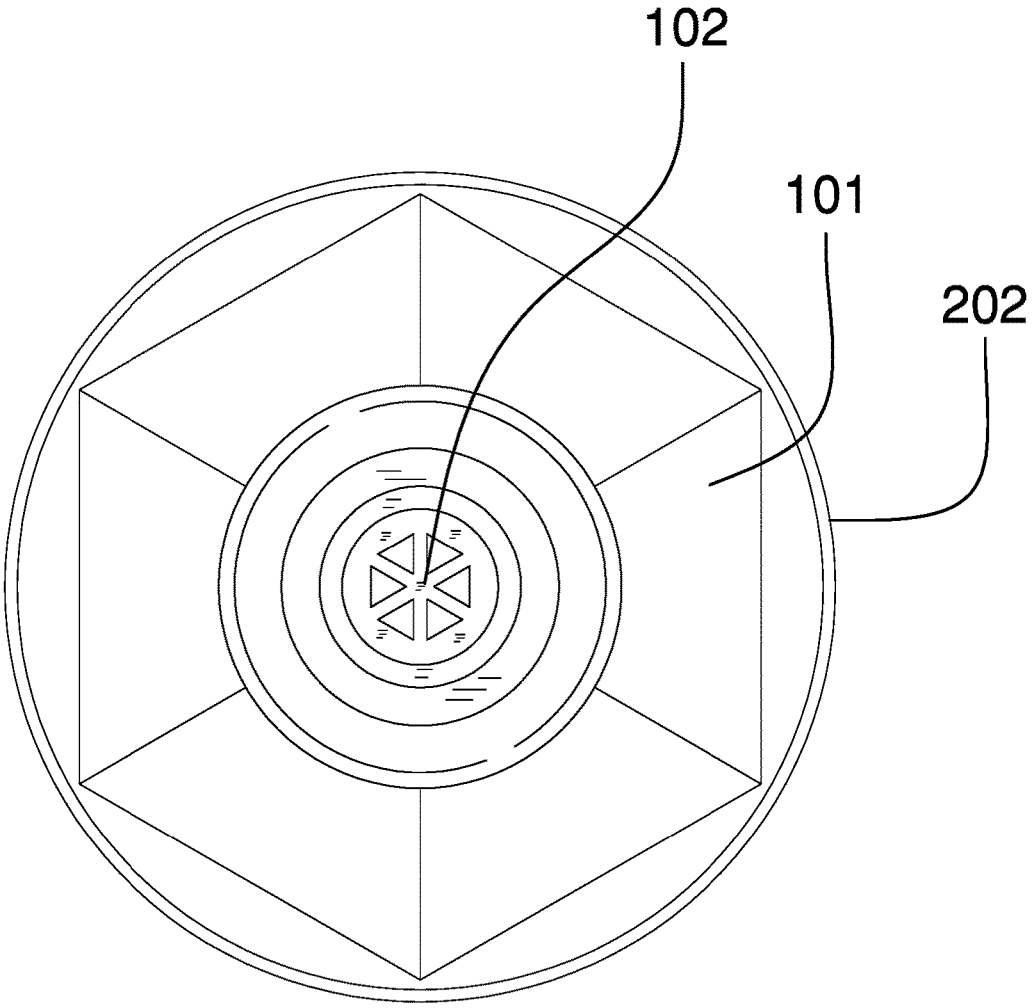
FIG. 3 is a bottom view of an embodiment of the disclosure.
Figure 4:
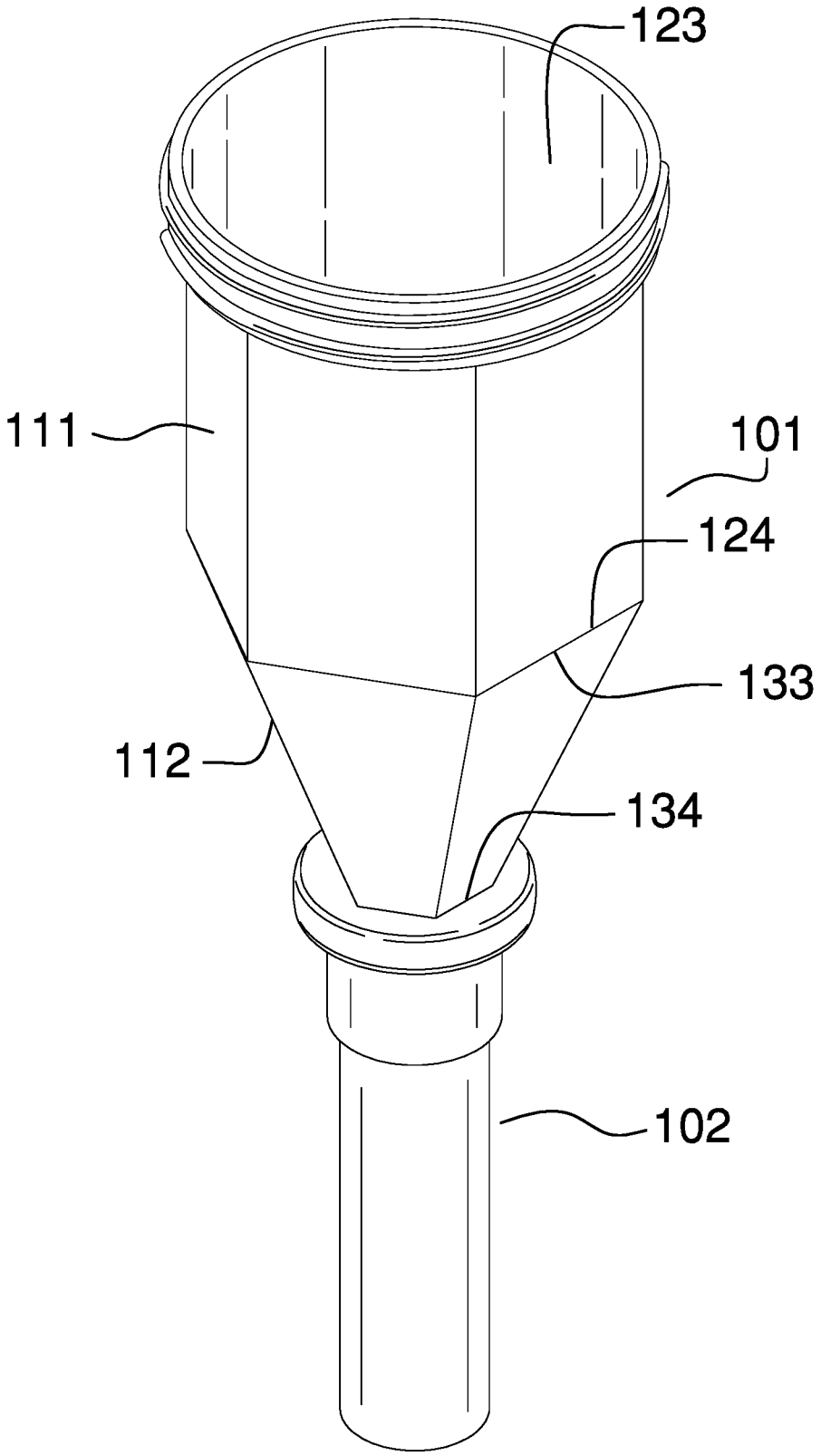
FIG. 4 is a perspective view of an alternative embodiment of the disclosure.
Figure 5:
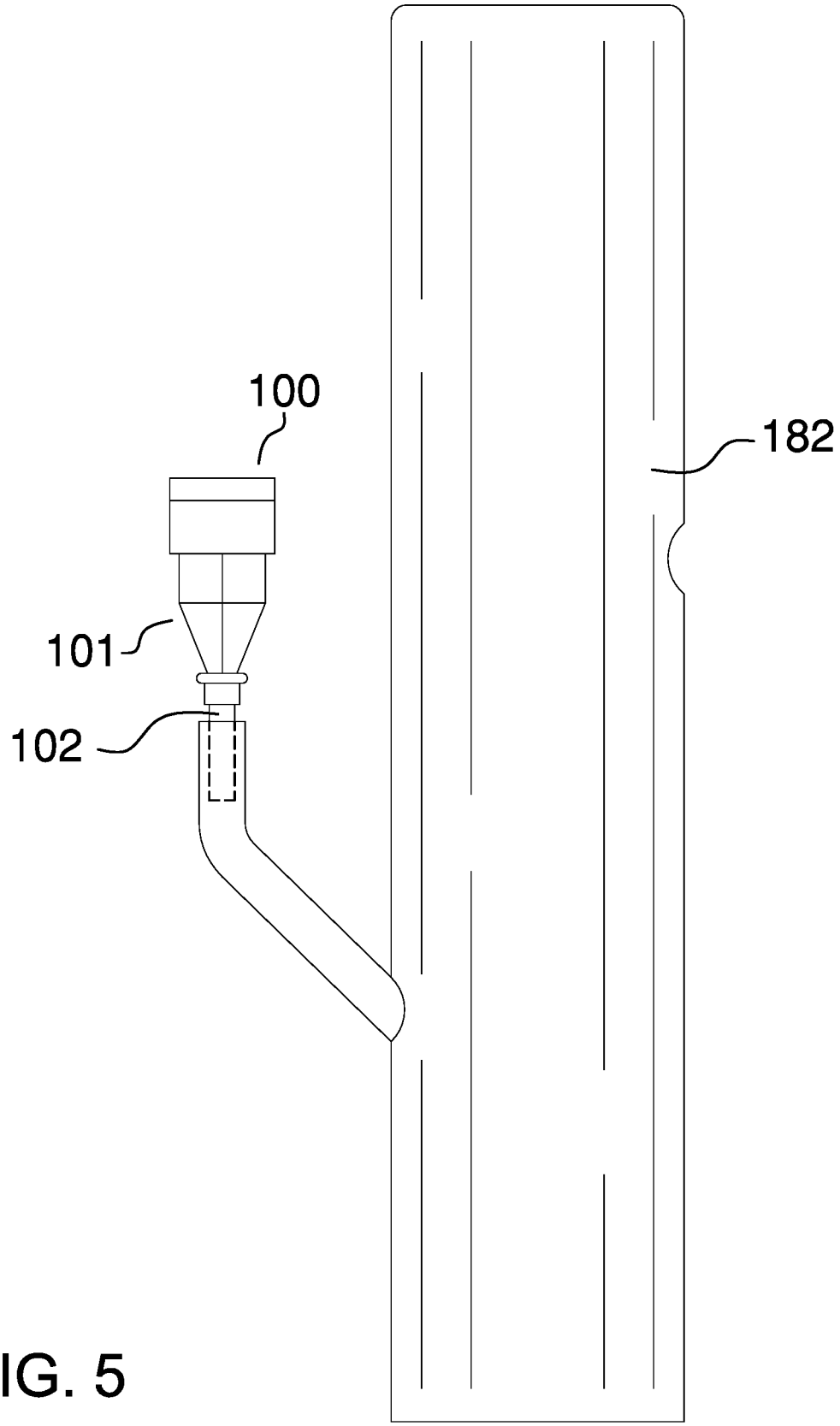
FIG. 5 is an in-use view of an embodiment of the disclosure.

Detailed reference will now be made to one or more potential embodiments of the disclosure, which are illustrated in FIGS. 1 through 5.

This non-provisional application is a continuation-in-part application filed under 37 CFR 1.53(b) that claims the benefit of United States 35 USC 120 from non-provisional application U.S. Ser. No. 16/253,282 filed on Jan. 22, 2019 by the inventor: William Parker of Raleigh, N.C. This non-provisional application incorporates non-provisional application U.S. Ser. No. 16/253,282 in its entirety.

The present disclosure will only reference the elements of the non-provisional application U.S. Ser. No. 16/253,282 that are relevant to the innovations disclosed within this application. This is done for purposes of simplicity and clarity of exposition. The applicant notes that this disclosure incorporates non-provisional application U.S. Ser. No. 16/253,282 in its entirety into this application. The fact that any specific innovation selected from the one or more innovations disclosed within U.S. Ser. No. 16/253,282 is not addressed in this application should not be interpreted as an indication of defect in the above referenced patent.

Within this disclosure, the non-provisional application U.S. Ser. No. 16/253,282 will also be referred to as the prior disclosure.

The bowl with attachable grinder for use with a pipe 100 (hereinafter invention) is a mechanical structure. The invention 100 is configured for use with the prior disclosure. The prior disclosure comprises a partitioned bowl 101. The partitioned bowl 101 comprises a prism structure 111 and a pyramid structure 112. The prism structure 111 is a hollow prism-shaped structure. The pyramid structure 112 is a hollow pyramid shaped structure. The pyramid structure 112 attaches to the prism structure 111 to form a composite prism structure 111. A gas phase of a pharmacologically active media 183 passes through the composite prism-shaped structure formed by the prism structure 111 and the pyramid structure 112. The gas phase of a pharmacologically active media 183 passes is generated by the combustion of a smoking material 181 within the partitioned bowl 101.

The partitioned bowl 101 is a composite prism structure. The partitioned bowl 101 is a hollow structure. The partitioned bowl 101 stores the smoking material 181. The partitioned bowl 101 forms a combustion chamber in which the smoking material 181. The partitioned bowl 101 transports the gas phase of a pharmacologically active media 183 generated by the smoking material 181 under vacuum into a hookah 182. The prism structure 111 comprises a prism intake port 123 and a prism exhaust port 124. The pyramid structure 112 comprises a pyramid intake port 133 and a pyramid exhaust port 134.

The prism structure 111 is described in greater detail in the background section of this disclosure. The pyramid structure 112 is described in greater detail in the background section of this disclosure. The prism intake port 123 is described in greater detail in the background section of this disclosure. The prism exhaust port 124 is described in greater detail in the background section of this disclosure. The pyramid intake port 133 is described in greater detail in the background section of this disclosure. The pyramid exhaust port 134 is described in greater detail in the background section of this disclosure.

The smoking material 181 is defined elsewhere in this disclosure. The hookah 182 is defined elsewhere in this disclosure. The terms gas, phase, and pharmacologically active media are defined elsewhere in this disclosure.

The invention 100 is configured for use with the hookah 182 that is described in the prior disclosure. The prior disclosure further comprises a partitioned bowl 101. The invention 100 comprises an exterior screw thread 201 and a burr grinder 202. The exterior screw thread 201 removably attaches the burr grinder 202 to the prism structure 111 of the partitioned bowl 101. The burr grinder 202 grinds the smoking material 181 in preparation for the combustion of the smoking material 181 within the partitioned bowl 101. The burr grinder 202 deposits the ground smoking material 181 directly into the prism structure 111 of the partitioned bowl 101.

The exterior screw thread 201 forms a threaded connection that attaches the burr grinder 202 to the prism structure 111 of the partitioned bowl 101. The exterior screw thread 201 is defined elsewhere in this disclosure. The exterior screw thread 201 is formed on the exterior surface of the lateral face of the prism structure 111 of the partitioned bowl 101 at a position proximal to the prism intake port 123 of the prism structure 111.

The burr grinder 202 is a mechanical device. The burr grinder 202 is a grinder. The burr grinder 202 receives the smoking material 181 and grinds the smoking material 181 into particles that form a bulk solid. The burr grinder 202 attaches to the prism intake port 123 of the prism structure 111 of the partitioned bowl 101 using a threaded connection. The burr grinder 202 transports the ground smoking material 181 to the prism intake port 123. The burr grinder 202 is a well-known and documented device. The burr grinder 202 is defined elsewhere in this disclosure. The burr grinder 202 comprises a funnel prism 211 and a lid prism 212.

The funnel prism 211 is a prism-shaped structure. The funnel prism 211 has a tube structure. The funnel prism 211 attaches to the prism intake port 123 of the prism structure 111 of the partitioned bowl 101. The funnel prism 211 transports the ground smoking material 181 directly into the prism intake port 123. The funnel prism 211 further comprises an interior screw thread 221, a funnel grinding disk 222, a proximal congruent end 223, and a distal congruent end 224.

The interior screw thread 221 forms a threaded connection that attaches the burr grinder 202 to the exterior screw thread of the prism structure 111 of the partitioned bowl 101. The interior screw thread 221 is defined elsewhere in this disclosure. The interior screw thread 221 is formed on the interior surface of the lateral face of the funnel prism 211 of the burr grinder 202 at a position proximal to the proximal congruent end 223 of the burr grinder 202. The exterior screw thread 201 is sized to screw into the interior screw thread 221 of the burr grinder 202 to form the threaded connection. This threaded connection removably attaches the prism structure 111 to the funnel prism 211 to attach the invention 100 to the prior disclosure.

The funnel grinding disk 222 is a disk-shaped structure. The funnel grinding disk 222 mounts in the funnel prism 211 at a position proximal to the distal congruent end 224 of the funnel prism 211. A congruent end of the funnel grinding disk 222 forms an abrasive surface. The funnel grinding disk 222 forms a portion of the working element of the burr grinder 202. The funnel grinding disk 222 inserts into the hollow interior of the funnel prism 211 such that the congruent ends of the disk structure of the funnel grinding disk 222 are perpendicular to the center axis of the prism shape of the funnel prism 211. The funnel grinding disk 222 inserts into the hollow interior of the funnel prism 211 such that the funnel grinding disk 222 does not rotate within the funnel prism 211.

The proximal congruent end 223 is the open congruent end of the funnel prism 211 that attaches to the prism structure 111 of the partitioned bowl 101. The distal congruent end 224 is the open congruent end of the funnel prism 211 that is distal from the proximal congruent end 223.

The lid prism 212 is a prism-shaped structure. The lid prism 212 has a capped-tube shape. The lid prism 212 removably attaches to the funnel prism 211 such that the lid prism 212 rotates relative to the funnel prism 211. The rotation of the lid prism 212 relative to the funnel prism 211 provides the motive forces required by the burr grinder 202 to grind the smoking material 181. The lid prism 212 further comprises a capped tube 231, a lid grinding disk 232, an open end 233, and a closed end 234.

The capped tube 231 is a prism-shaped structure. The capped tube 231 has a hollow capped-tube shape. The capped tube 231 forms the outer contours of the lid prism 212.

The lid grinding disk 232 is a disk-shaped structure. The lid grinding disk 232 mounts in the lid prism 212 at a position proximal to the open end 233 of the lid prism 212. A congruent end of the lid grinding disk 232 forms an abrasive surface. The lid grinding disk 232 forms a portion of the working element of the burr grinder 202. The lid grinding disk 232 combines with the funnel grinding disk 222 to form the working element of the burr grinder 202.

The abrasive congruent end of the funnel grinding disk 222 faces the abrasive congruent end of the lid grinding disk 232 such that the rotation of the lid grinding disk 232 relative to the funnel grinding disk 222 grinds the smoking material 181. The lid grinding disk 232 inserts into the hollow interior of the capped tube 231 such that the congruent ends of the disk structure of the lid grinding disk 232 are perpendicular to the center axis of the prism shape of the lid prism 212. The lid grinding disk 232 inserts into the hollow interior of the capped tube 231 such that the lid grinding disk 232 does not rotate within the lid prism 212. The rotation of the lid prism 212 relative to the funnel prism 211 rotates the lid grinding disk 232 relative to the funnel grinding disk 222 to create the grinding motion required to grind the smoking material 181.

The open end 233 is the open congruent end of the capped tube 231 that attaches to the funnel prism 211. The open end 233 is the open congruent end of the lid prism 212 that is distal from the open end 233.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Apex: As used in this disclosure, an apex is a vertex that forms an extreme or solitary point of an object.

Bowl: As used in this disclosure, a bowl is a rounded hollow structure used to store a material.

Bulk Solid: As used in this disclosure, a bulk solid is a material that is formed from an accumulation of discrete particles. While the discrete particles of the bulk solid are solid materials, in aggregate the physical performance of bulk solid will exhibit fluid characteristics such as flow or taking the shape of a container.

Bulkhead: As used in this disclosure, a bulkhead is a vertical barrier, often referred to as a wall, which subdivides a space into compartments.

Burr Grinder: As used in this disclosure, a burr grinder is a type of grinder. The burr grinder grinds material that is place between two rotating abrasive surfaces. The burr grinder is known for grinding material into particles of a consistent size. The burr grinder is also known as a burr mill.

Calibration: As used in this disclosure, a calibration refers to a standard scale that is marked on an instrument, and that is used for measurement. In its verbal form, to calibrate refers to comparing an instrument's calibration against a known and trusted standard to ensure that the calibration of the remains correct.

Capped Tube: As used in this disclosure, a capped tube is a tube with one closed end and one open end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Combustion: As used in this disclosure, combustion refers to a reduction-oxidation reaction wherein oxygen and a hydrocarbon are combined to release energy, carbon dioxide, and water. In general usage, the meaning of combustion is often extended to describe a reaction between oxygen and a fuel source, such as a hydrocarbon modified by functional groups, which releases energy.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object. Always use Geometrically similar, correspond and one to one Correspond: As used in this disclosure, the term correspond is used as a comparison between two or more objects wherein one or more properties shared by the two or more objects match, agree, or align within acceptable manufacturing tolerances.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Disk: As used in this disclosure, a disk is a prism-shaped object that is flat in appearance. Specifically, the sum of the surface areas of two ends of the prism-shaped object that forms the disk is greater than the surface area of the lateral face of the prism-shaped object that forms the disk. In this disclosure, the ends of the prism-shaped structure that forms the disk are referred to as the faces of the disk.

Dose: As used in this disclosure, the term dose refers to a specified measured quantity of a chemical substance that is to be incorporated or introduced into an organism or a mixture such as a recipe or a solution. The term dose often, but not necessarily, implies the introduction of a therapeutic substance or a pharmacologically active media into a patient.

Exterior: As used in this disclosure, the exterior is used as a relational term that implies that an object is not contained within the boundary of a structure or a space.

Exterior Screw Thread: An exterior screw thread is a ridge wrapped around the outer surface of a tube in the form of a helical structure that is used to convert rotational movement into linear movement.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grinder: As used in this disclosure, a grinder is a machine that reduces a material into small particles.

Hookah: As used in this disclosure, a hookah is a device used to distribute one or more doses of a pharmacologically active media in a gas phase. The hookah: a) provides a chamber for the combustion of a smoking material such that the smoking material will release a pharmacologically active media in a gas phase; b) transports the gas phase of the pharmacologically active media through a water-filled chamber; and, c) presents the gas phase of the pharmacologically active media to a patient for consumption.

Inner Dimension: As used in this disclosure, the term inner dimension describes the span from a first inside or interior surface of a container to a second inside or interior surface of a container. The term is used in much the same way that a plumber would refer to the inner diameter of a pipe.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Interior Screw Thread: An interior screw thread is a groove that is formed around the inner surface of a tube in the form of a helical structure that is used to convert rotational movement into linear movement.

Liquid: As used in this disclosure, a liquid refers to a state (phase) of matter that is fluid and that maintains, for a given pressure, a fixed volume that is independent of the volume of the container.

Loop: As used in this disclosure, a loop is the length of a first linear structure including, but not limited to, shafts, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can insert through the space formed within the first linear structure. Within this disclosure, the first linear structure is said to loop around the second linear structure.

N-gon: As used in this disclosure, an N-gon is a regular polygon with N sides wherein N is a positive integer number greater than 2.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Particle: As used in this disclosure, a particle is a discrete object of a small size relative to the context of a discussion. The term particle is used when: a) the volume of the particle; b) the structure of the particle; and, c) the motion of elements within the particle are not relevant to the context of the discussion.

Patient: As used in this disclosure, a patient is a person who is designated to receive a medical treatment, therapy or service. The term patient may be extended to an animal when used within the context of the animal receiving veterinary treatment or services Pharmacologically Active Media: As used in this disclosure, a pharmacologically active media refers to a chemical substance that has a biochemical or physiological effect on a biological organism.

Phase: As used in this disclosure, phase refers to the state of the form of matter. The common states of matter are solid, liquid, gas, and plasma.

Pipe: As used in this disclosure, a pipe is a hollow prism-shaped device that is suitable for use in transporting a fluid. The line that connects the center of the first base of the prism to the center of the second base of the prism is referred to as the axis of the prism or the centerline of the pipe. When two pipes share the same centerline, they are said to be aligned. In this disclosure, the terms inner dimension of a pipe and outer dimension are used as they would be used by those skilled in the plumbing arts.

Plate: As used in this disclosure, a plate is a smooth, flat and semi-rigid or rigid structure that has at least one dimension that: a) is of uniform thickness; and b) that appears thin relative to the other dimensions of the object. Plates often have a rectangular appearance. Plates often have a disk-like structure. The face of the plate is a surface of the plate selected from the group consisting of: a) the surface of the plate with the greatest surface area; b) the surface of the plate that is distal from the surface of the plate with the greatest surface area. The edges of the plate comprise the surfaces of the plate that would not be considered faces as defined above. As defined in this disclosure, plates may be made of any material, but are commonly made of metal, plastic, and wood. When made of wood, a plate is often referred to as a board or a plank.

Polygon: As used in this disclosure, a polygon refers to a closed planar figure comprising three or more sides. Any two adjacent sides selected from the three or more sides attach to each other such that the two adjacent sides form an interior arc with a cant of less than 180 degrees. A regular polygon is defined as a polygon wherein: a) the span of the length of any side selected from the three or more sides equals the span of the length of any unselected side remaining in the three or more sides; and, b) the arc of the cant between any two adjacent sides selected from the three or more sides equals the arc of the cant of any two unselected sides remaining in the three or more sides. Polygons are often referred to as N-gons where N refers to the number of sides. For example, a pentagon has five sides and a hexagon has six sides.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pyramid: As used in this disclosure, a pyramid is a three-dimensional shape that comprises a base formed in the shape of an N-gon (wherein N is an integer) with N triangular faces that rise from the base to converge at a point above the base. If the point where the N faces meet is positioned such that a line drawn from the point where the N faces meet to the center of the N-gon base is perpendicular to the N-gon base, the pyramid is referred to as a right pyramid. Pyramids can be further formed with circular or elliptical bases which are commonly referred to as cone or an elliptical pyramid respectively. A pyramid is defined with a base, an apex, and a lateral face. The base is the N-gon shaped base described above. The apex is the convergence point described above. The lateral face is formed from the N triangular faces described above.

Radial: As used in this disclosure, the term radial refers to a direction that: 1) is perpendicular to an identified central axis; or, 2) projects away from a center point.

Reduction-Oxidation Reaction: As used in this disclosure, a reduction-oxidation reaction (also known as a redox reaction) is a chemical reaction involving the transfer of electrons between the reactants of the reaction.

Ring: As used in this disclosure, a ring is a term that is used to describe a flat or plate-like structure through which an aperture is formed. Rings are often considered loops.

Scale: As used in this disclosure, refers to a visual system of ordered markings that are used as a reference for measurement.

Smoking Material: As used in this disclosure, smoking materials are combustible materials that are intended to be deeply inhaled as the smoking material burns. This definition is intended to include, but is not limited to, tobacco and materials that exhibit pharmacological activity such as marijuana. This definition is intended to include vaporizing devices commonly used to evaporate or sublimate materials into a gas phase that simulate the smoking experience. This definition is intended to exclude combustible materials that are burned as a perfume but that are generally not purposefully inhaled including, but not limited to, incense and scented oils.

Solid: As used in this disclosure, a solid refers to a state (phase) of matter that: 1) has a fixed volume; and, 2) does not flow.

Superior: As used in this disclosure, the term superior refers to a directional reference that is parallel to and in the opposite direction of the force of gravity when an object is positioned or used normally.

Therapeutic: As used in this disclosure, therapeutic is an adjective that refers to a medical, ameliorative, or hygienic substance, process, or procedure.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Truncated: As used in this disclosure, a geometric object is truncated when an apex, vertex, or end is cut off by a line or plane.

Truncated Pyramid: As used in this disclosure, a truncated pyramid is a frustum that remains when the apex of a pyramid is truncated by a plane that is parallel to the base of the pyramid.

Tube: As used in this disclosure, a tube is a hollow prism-shaped device formed with two open ends. The tube is used for transporting liquids and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Vacuum: As used in this disclosure, a vacuum is used to describe a first space that contains gas at a reduced gas pressure relative to the gas pressure of a second space. If the first space and the second space are connected together, this pressure differential will cause gas from the second space to move towards the first space until the pressure differential is eliminated.

Vertex: As used in this disclosure, a vertex (plural vertices) is an angle that is formed by two lines (or a plurality of surfaces) that form a point. Vertices are commonly found in polygons, prisms, and pyramids.

Working Element: As used in this disclosure, the working element of a tool is the physical element on the tool that performs the actual activity, operation, or procedure the tool is designed to perform. For example, the cutting edge of a blade is the working element of a knife.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An accessory for a hookah comprising
a partitioned bowl, an exterior screw thread, and a burr grinder;
wherein the exterior screw thread removably attaches the burr grinder to a prism structure of the partitioned bowl;
wherein the partitioned bowl comprises the prism structure and a pyramid structure;
wherein the pyramid structure attaches to the prism structure to form a composite prism structure;
wherein a gas phase of a pharmacologically active media passes through the composite prism-shaped structure formed by the prism structure and the pyramid structure;
wherein the gas phase of a pharmacologically active media is generated by the combustion of a smoking material within the partitioned bowl;
wherein the partitioned bowl transports the gas phase of a pharmacologically active media generated by the smoking material under vacuum into the hookah.

2. The accessory for a hookah according to claim 1
wherein the prism structure is a hollow prism-shaped structure;
wherein the pyramid structure is a hollow pyramid shaped structure.

3. The accessory for a hookah according to claim 2
wherein the prism structure comprises a prism intake port and a prism exhaust port;
wherein the pyramid structure comprises a pyramid intake port;
wherein the exterior screw thread is formed at the prism intake port;
wherein the prism exhaust port attaches to the pyramid intake port to form the composite prism structure of the partitioned bowl.

4. The accessory for a hookah according to claim 3
wherein the burr grinder grinds the smoking material;
wherein the burr grinder deposits the ground smoking material directly into the prism structure of the partitioned bowl.

5. The accessory for a hookah according to claim 4 wherein the exterior screw thread forms a threaded connection with the burr grinder.

6. The accessory for a hookah according to claim 5 wherein the exterior screw thread is formed on the exterior surface of the lateral face of the prism structure of the partitioned bowl at a position proximal to the prism intake port of the prism structure.

7. The accessory for a hookah according to claim 6
wherein the burr grinder is a mechanical device;
wherein the burr grinder is a grinder;
wherein the burr grinder attaches to the prism intake port of the prism structure of the partitioned bowl using a threaded connection.

8. The accessory for a hookah according to claim 7
wherein the burr grinder receives the smoking material and grinds the smoking material into particles that form a bulk solid;
wherein the burr grinder transports the ground smoking material to the prism intake port.

9. The accessory for a hookah according to claim 8
wherein the burr grinder comprises a funnel prism and a lid prism;
wherein the lid prism removably attaches to the funnel prism.

10. The accessory for a hookah according to claim 9
wherein the funnel prism is a prism-shaped structure;
wherein the funnel prism has a tube structure;
wherein the funnel prism attaches to the prism intake port of the prism structure of the partitioned bowl;
wherein the funnel prism transports the ground smoking material directly into the prism intake port.

11. The accessory for a hookah according to claim 10
wherein the lid prism is a prism-shaped structure;
wherein the lid prism has a capped-tube shape;
wherein the lid prism removably attaches to the funnel prism such that the lid prism rotates relative to the funnel prism;
wherein the rotation of the lid prism relative to the funnel prism provides the motive forces required by the burr grinder to grind the smoking material.

12. The accessory for a hookah according to claim 11
wherein the funnel prism further comprises an interior screw thread, a funnel grinding disk, a proximal congruent end, and a distal congruent end;
wherein the funnel grinding disk mounts in the funnel prism;
wherein the interior screw thread is formed in the funnel prism;
wherein the proximal congruent end is a congruent end of the funnel prism;
wherein the distal congruent end is the congruent end of the funnel prism that is distal from the funnel prism;
wherein the proximal congruent end is the open congruent end of the funnel prism that attaches to the prism structure of the partitioned bowl;
wherein the distal congruent end is the open congruent end of the funnel prism that is distal from the proximal congruent end.

13. The accessory for a hookah according to claim 12
wherein the lid prism further comprises a capped tube, a lid grinding disk, an open end, and a closed end;
wherein the lid grinding disk mounts in the lid prism;
wherein the open end is the open congruent end of the capped tube that attaches to the funnel prism;
wherein the open end is the open congruent end of the lid prism that is distal from the open end.

14. The accessory for a hookah according to claim 13 wherein the interior screw thread forms a threaded connection that attaches the burr grinder to the exterior screw thread of the prism structure of the partitioned bowl.

15. The accessory for a hookah according to claim 14
wherein the interior screw thread is formed on the interior surface of the lateral face of the funnel prism of the burr grinder at a position proximal to the proximal congruent end of the burr grinder;
wherein the exterior screw thread is sized to screw into the interior screw thread of the burr grinder to form the threaded connection.

16. The accessory for a hookah according to claim 15
wherein the funnel grinding disk is a disk-shaped structure;

wherein the funnel grinding disk mounts in the funnel prism at a position proximal to the distal congruent end of the funnel prism;

wherein a congruent end of the funnel grinding disk forms an abrasive surface;

wherein the funnel grinding disk forms a portion of a working element of the burr grinder.

17. The accessory for a hookah according to claim 16 wherein the funnel grinding disk inserts into the hollow interior of the funnel prism such that the congruent ends of the disk structure of the funnel grinding disk are perpendicular to the center axis of the prism shape of the funnel prism;

wherein the funnel grinding disk inserts into the hollow interior of the funnel prism such that the funnel grinding disk does not rotate within the funnel prism.

18. The accessory for a hookah according to claim 17 wherein the capped tube is a prism-shaped structure;

wherein the capped tube has a hollow capped-tube shape;

wherein the capped tube forms the outer contours of the lid prism.

19. The accessory for a hookah according to claim 18 wherein the lid grinding disk is a disk-shaped structure;

wherein the lid grinding disk mounts in the lid prism at a position proximal to the open end of the lid prism;

wherein a congruent end of the lid grinding disk forms an abrasive surface;

wherein the lid grinding disk forms a portion of the working element of the burr grinder;

wherein the lid grinding disk combines with the funnel grinding disk to form the working element of the burr grinder.

20. The accessory for a hookah according to claim 19 wherein the abrasive congruent end of the funnel grinding disk faces the abrasive congruent end of the lid grinding disk such that the rotation of the lid grinding disk relative to the funnel grinding disk grinds the smoking material;

wherein the lid grinding disk inserts into the hollow interior of the capped tube such that the congruent ends of the disk structure of the lid grinding disk are perpendicular to the center axis of the prism shape of the lid prism;

wherein the lid grinding disk inserts into the hollow interior of the capped tube such that the lid grinding disk does not rotate within the lid prism;

wherein the rotation of the lid prism relative to the funnel prism rotates the lid grinding disk relative to the funnel grinding disk to create the grinding motion required to grind the smoking material.

* * * * *